US008312933B2

(12) United States Patent
Larson et al.

(10) Patent No.: US 8,312,933 B2
(45) **Date of Patent: *Nov. 20, 2012**

(54) MARINE DRILLING RISER SYSTEM

(75) Inventors: Eric D. Larson, Tomball, TX (US); Rick L. Stringfellow, Houston, TX (US); Richard T. Trenholme, Houston, TX (US)

(73) Assignee: Vetco Gray Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/074,858

(22) Filed: Mar. 29, 2011

(65) Prior Publication Data

US 2011/0174495 A1 Jul. 21, 2011

Related U.S. Application Data

(63) Continuation of application No. 12/139,793, filed on Jun. 16, 2008, now Pat. No. 7,913,767.

(51) Int. Cl.

| | |
|---|---|
| ***E21B 7/12*** | (2006.01) |
| ***E21B 19/16*** | (2006.01) |
| ***F16L 55/00*** | (2006.01) |

(52) U.S. Cl. ..... 166/380; 165/242.6; 165/344; 165/345; 165/359; 285/82; 285/922

(58) Field of Classification Search ..... 166/380, 166/242.6, 344, 345, 348, 350, 359, 367; 285/333, 334, 922, 315, 26, 29, 82, 84
See application file for complete search history.

(56) References Cited

U.S. PATENT DOCUMENTS

| | | | | |
|---|---|---|---|---|
| 3,256,936 | A * | 6/1966 | Johnson et al. | 166/354 |
| 3,521,909 | A * | 7/1970 | Brown | 285/3 |
| 4,491,346 | A * | 1/1985 | Walker | 285/18 |

* cited by examiner

*Primary Examiner* — Shane Bomar
*Assistant Examiner* — Catherine Loikith
(74) *Attorney, Agent, or Firm* — Bracewell & Giuliani LLP

(57) ABSTRACT

A marine drilling riser system for securing drilling riser joints in a drilling riser string is presented. The drilling riser string is assembled by connecting a pin end of one drilling riser joint to a box end of an adjoining drilling riser joint by using a moveable ring to drive a fastener of one drilling riser joint against the adjoining drilling riser joint. A spider is used to drive the movable ring axially from a position where the fastener is not engaged against the adjoining drilling riser joint to a position where the fastener is engaged against the adjoining drilling riser joint, and vice versa. A latch is used to prevent the moveable ring from moving inadvertently from the second position. The spider may also be used to support the marine drilling riser string during assembly.

16 Claims, 9 Drawing Sheets

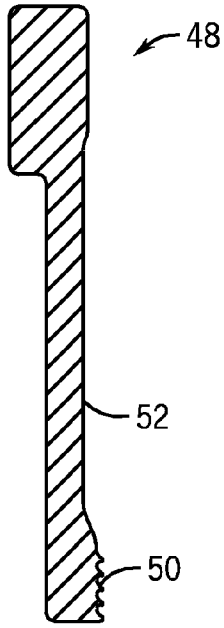
FIG. 4
FIG. 5
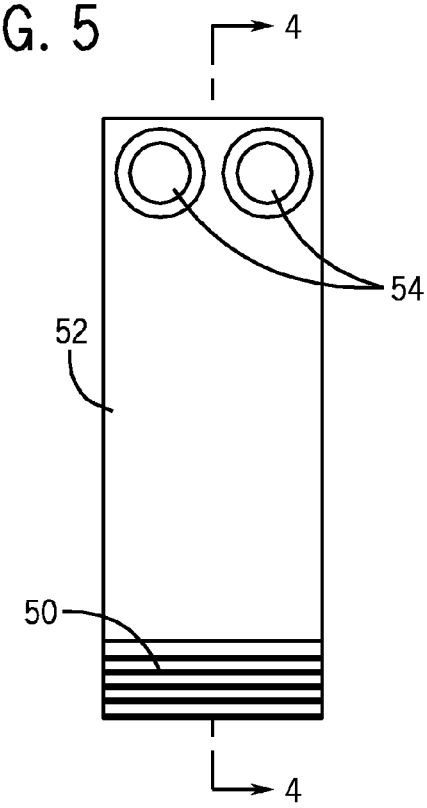
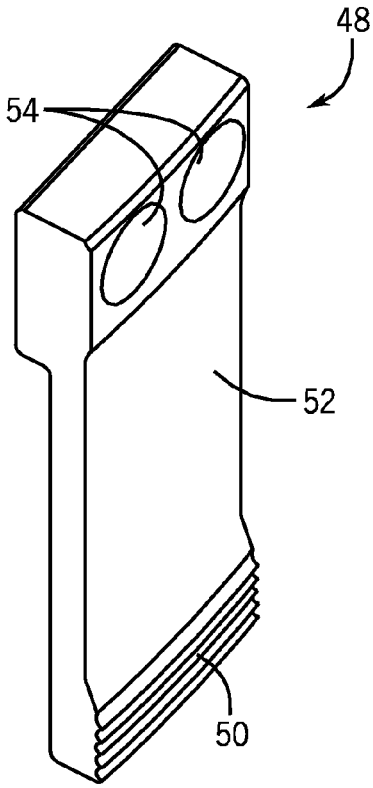
FIG. 6

MARINE DRILLING RISER SYSTEM

CROSS-REFERENCE TO RELATED APPLICATIONS

This application is a Continuation of Ser. No. 12/139,793, which is now U.S. Pat. No. 7,913,767, filed Jun. 16, 2008.

FIELD OF THE INVENTION

The present invention relates to a system for providing a secondary means of securing tubular members held together by a friction-lock system. In particular, the present invention relates to a mechanical latch that prevents drilling risers that are held together by friction from separating inadvertently.

BACKGROUND

In offshore drilling operations in deep water, the operator will perform drilling operations through a drilling riser string. The drilling riser string extends from a floating platform, such as a drilling ship, to a subsea wellhead or subsea tree assembly on the seafloor. The drilling riser string is made up of a number of individual riser joints or sections that are secured together to form the drilling riser string. The drilling riser string forms a central tube for passing a drill pipe from the floating platform to the wellhead on the sea floor. The drilling riser string normally has a number of auxiliary conduits that extend around the central tube. The auxiliary conduits may serve several purposes, such as supplying hydraulic fluid pressure to the subsea blowout preventer and lower marine riser package.

Typically, the central tube of a drilling riser joint has a pin member on one end and a box member on the other end. The pin end of one riser joint stabs into the box end of the adjoining riser joint. In one type of riser joint, flanges extend outward from the pin and box. The operator connects the flanges together with bolts spaced around the circumference of the coupling. In another type of riser, individual segments or locking segments are spaced around the circumference of the box. A screw is connected to each locking segment. Rotating the screw causes the locking segment to advance into engagement with a profile formed on the end of a pin.

In these systems, a riser spider or support on a riser deploying floor moves between a retracted position into an engaged position to support previously made-up riser joints while the new riser joint is being stabbed into engagement with the string. Wave movement can cause the vessel to be moving upward and downward relative to the riser when the riser is in operation.

In both types of risers, workers use wrenches to make up the bolts or screws. Personnel employed to secure the screws or the bolts are exposed to a risk of injury. Also, the process of making up the individual bolts is time consuming. Often when moving the drilling rig from one location to another, the riser has to be pulled and stored. In very deep water, pulling and rerunning the riser is very expensive.

A technique has been developed that uses a cam ring and dogs to secure drilling riser joints together. Each riser joint has a box end and a pin end. The pin end of one drilling riser joint is disposed within the box end of an adjoining drilling riser joint. The box ends of each drilling riser joint have dogs that are driven into engagement with the pin ends of the adjoining drilling riser joints by moving the cam ring axially. Friction between the dogs and the cam ring maintains the cam ring positioned to drive the dogs against the pin end of the adjoining drilling riser joint. No bolts or screws are used to connect drilling riser joints using this technique.

However, it is conceivable that friction may not be sufficient to maintain the cam rings at their desired axial positions so that the cam rings drive the dogs against the pin ends of the adjoining drilling riser joints. Were a cam ring to move from its desired axial position, its dogs could back out from the pin end of the adjoining drilling riser joint. If that were to occur, the drilling riser joints may disconnect from each other.

Therefore, a more effective technique is needed to secure drilling riser joints together. In particular, a technique is desired that would enable adjoining drilling riser joints to be connected quickly and remain connected during operation.

BRIEF DESCRIPTION

A technique for securing drilling riser joints in a drilling riser string is presented. The drilling riser joints have a tubular housing that has a box configuration on one end and a pin configuration on the other end. The drilling riser string is assembled by connecting the pin end of one drilling riser joint to the box end of an adjoining drilling riser joint. A moveable ring is used to connect adjoining drilling riser joints. The moveable ring is used to drive a fastener, such as a dog, of one drilling riser joint against the adjoining drilling riser joint. The moveable ring is driven axially from a first position, where the fastener is not engaged against the adjoining drilling riser joint, to a second position, where the fastener is engaged against the adjoining drilling riser joint.

The technique also comprises the use of a latch to prevent the moveable ring from moving inadvertently from the second position. This prevents the drilling riser joints from disconnecting inadvertently. In the embodiment described below, the latch has a cantilevered arm having a toothed profile. The moveable ring also has a toothed profile that corresponds with the toothed profile on the latch. When the moveable ring is in the second position, the toothed profile on the latch engages the toothed profile on the moveable ring. The engagement of the toothed profile on the latch with the toothed profile on the moveable ring obstructs axial movement of the moveable ring. To disconnect the drilling riser joints, a tool is used to provide sufficient force to overcome the engagement of the toothed profiles on the latch and the moveable ring.

DRAWINGS

These and other features, aspects, and advantages of the present invention will become better understood when the following detailed description is read with reference to the accompanying drawings in which like characters represent like parts throughout the drawings, wherein:

FIGS. 4-6 are a side elevation view, a front elevation view, and a perspective view of the secondary latch for a riser joint connection, in accordance with an exemplary embodiment of the present technique;

Figure 8:
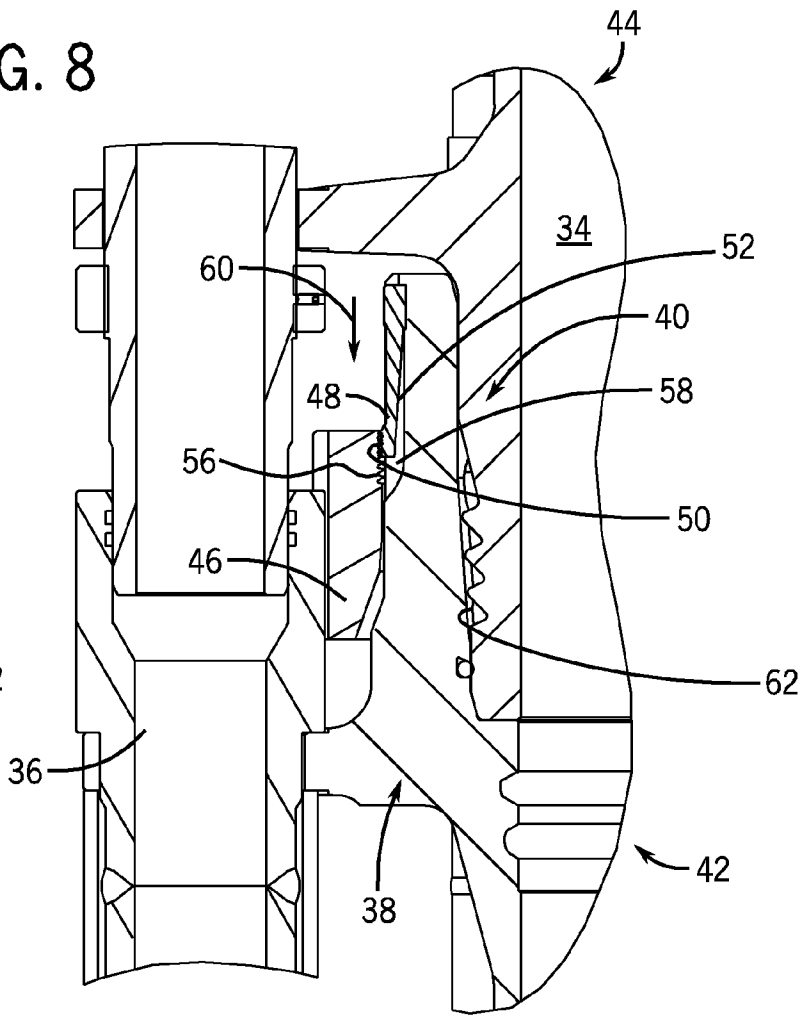
Figure 9:
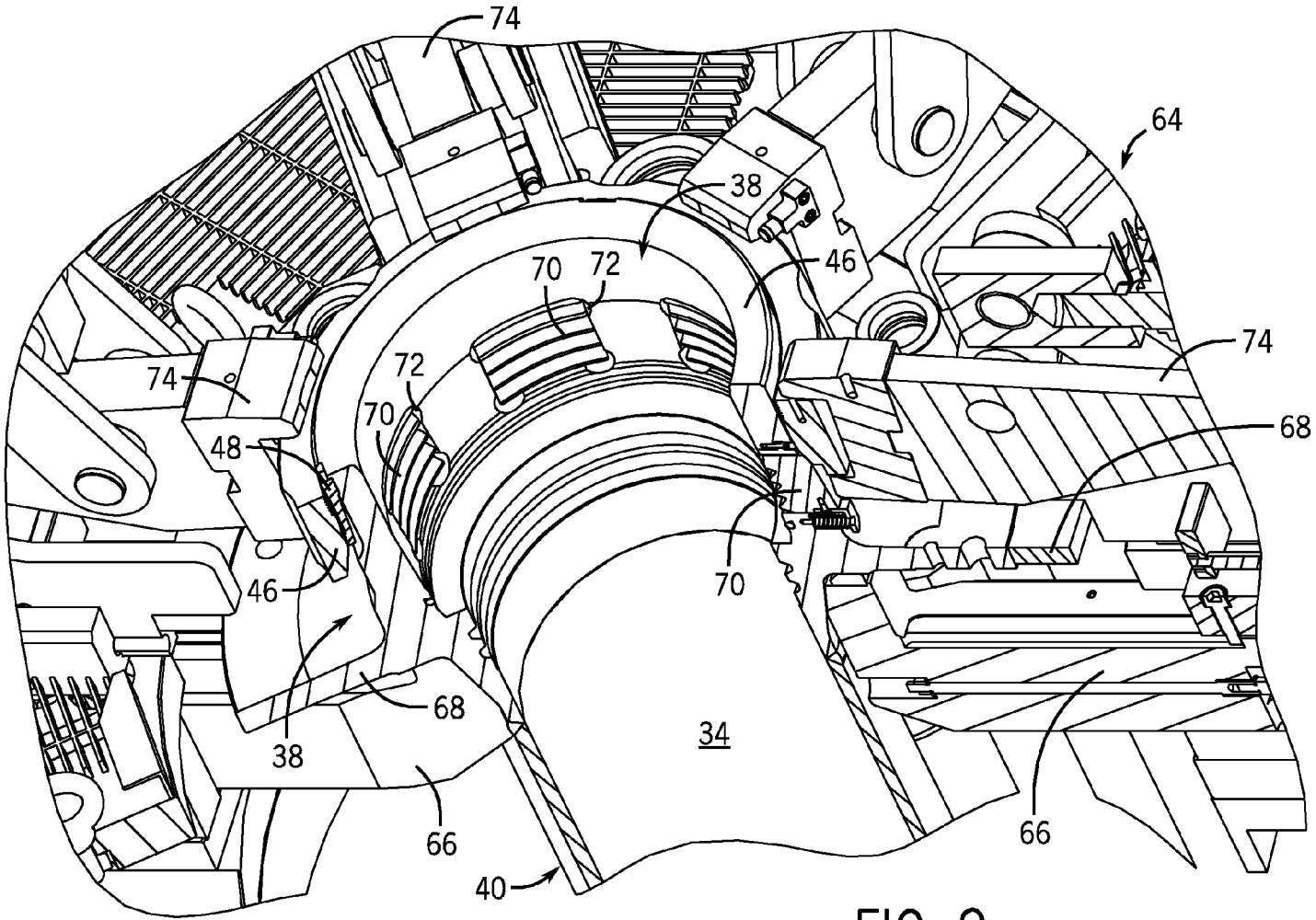
Figure 10:
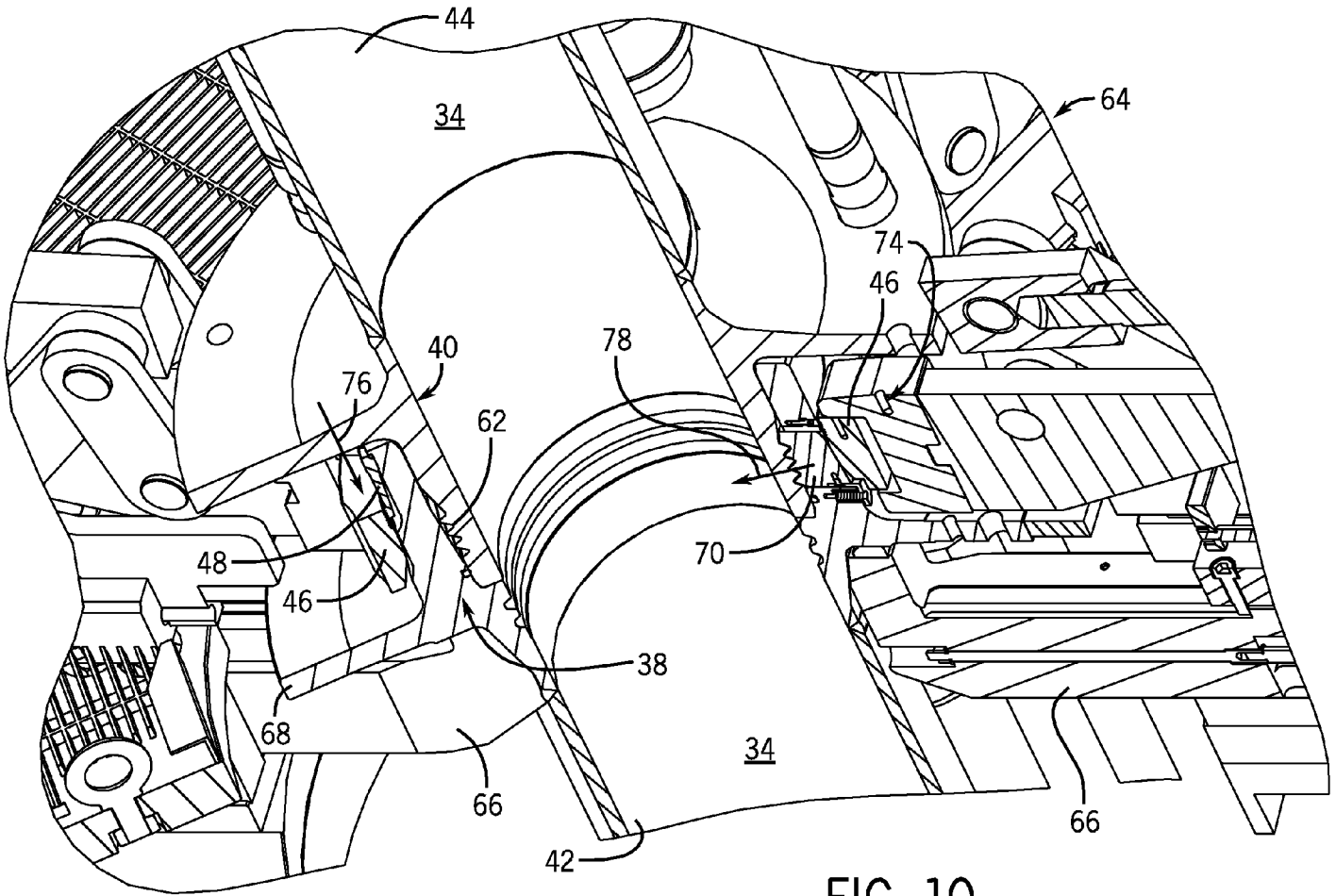
Figure 13:
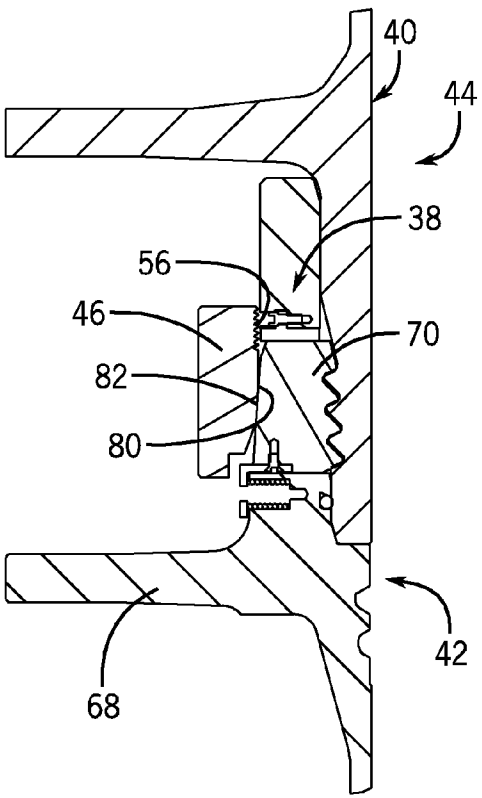
Figure 12:
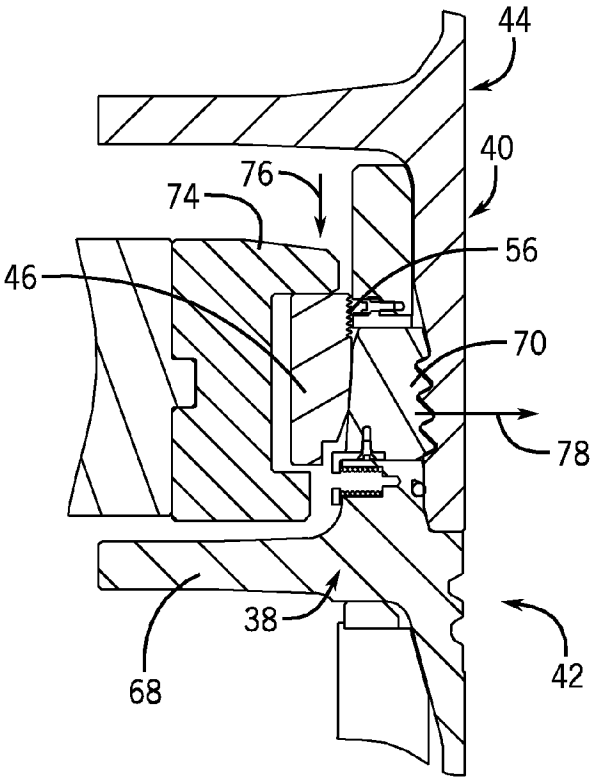
Figure 11:
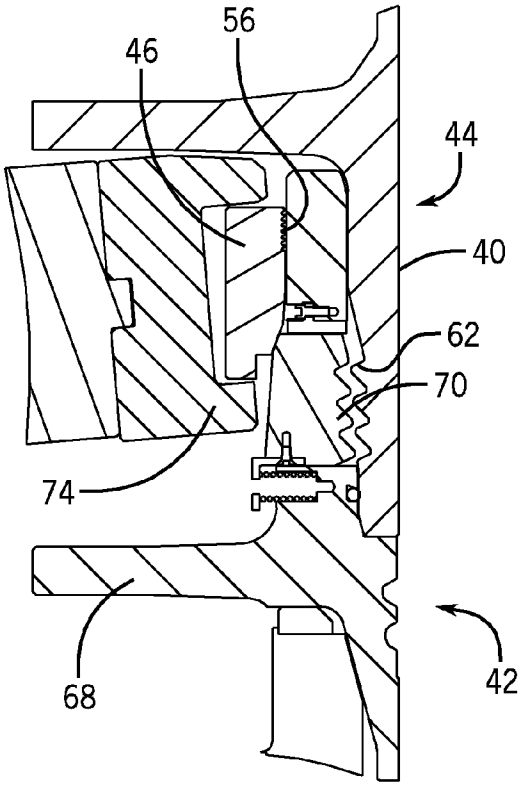

FIG. 8 is an elevation view of the first drilling riser joint and second drilling riser joint with a cam ring used to secure the first drilling joint to the second drilling riser joint in a second axial position, in accordance with an exemplary embodiment of the present technique FIG. 9 is a partial cross-sectional view of a drilling riser joint and a system for connecting drilling riser joints together, in accordance with an exemplary embodiment of the present technique;

FIG. 10 is a partial cross-sectional view of a pair of drilling riser joints joined together by the system for connecting drilling riser joints together, in accordance with an exemplary embodiment of the present technique; and FIGS. 11-13 are a sequence of elevation views illustrating the use of retractable jaws to connect a first drilling riser joint to a second drilling riser joint, in accordance with an exemplary embodiment of the present technique.

Figure 14:
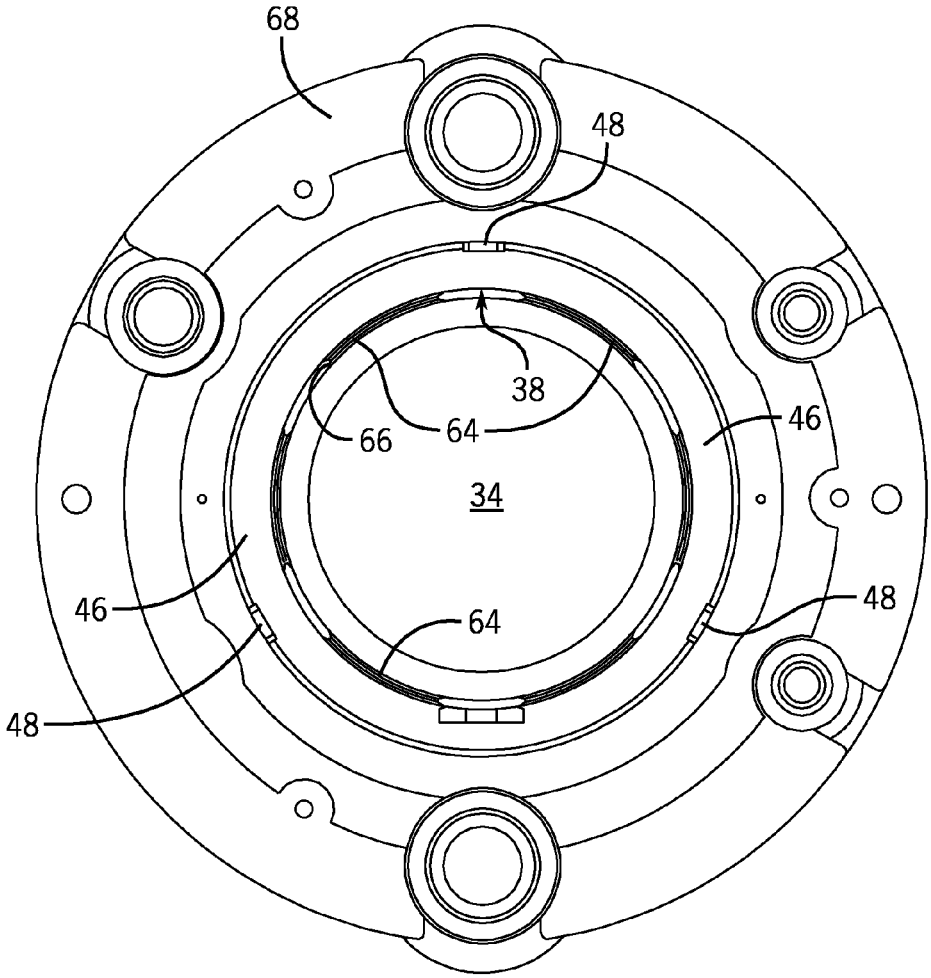

FIG. 14 is a top cross-sectional view of a riser joint connection, in accordance with an exemplary embodiment of the present technique;

DETAILED DESCRIPTION

Figure 1:
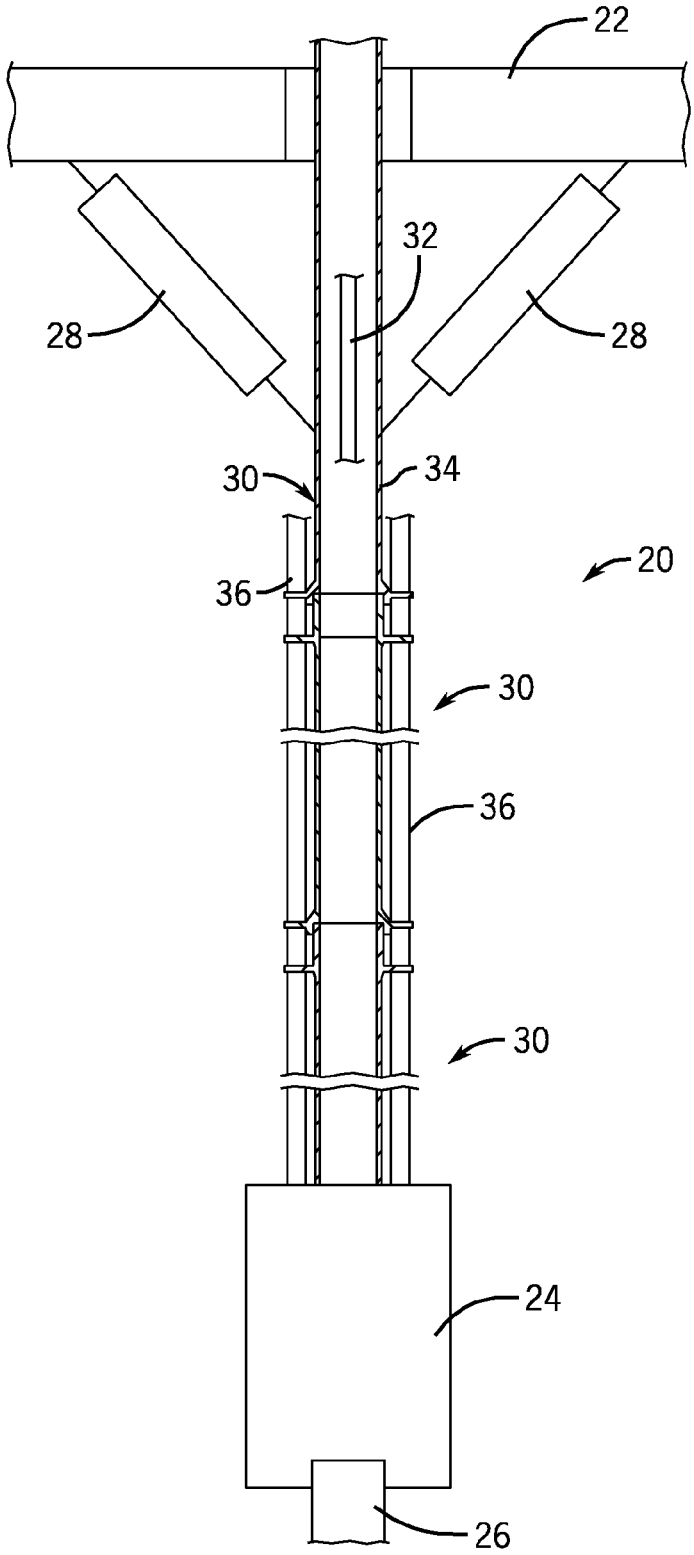
FIG. 1 is a schematic view of a drilling riser system, in accordance with an exemplary embodiment of the present technique.

Referring now to FIG. 1, the present invention will be described as it might be applied in conjunction with an exemplary technique, in this case, a drilling riser string 20 to enable a subsea well to be drilled from a floating platform 22. The drilling riser string 20 is secured to a lower marine riser package and Blowout Preventer (BOP) stack 24, which is, in turn, secured to a subsea wellhead or subsea tree 26 of the well. The drilling riser string 20 is supported in tension by riser tensioners 28 suspended from the floating platform 22.

The drilling riser string 20 is comprised of a series of riser joints 30 that are connected together to form several tubes that extend from the floating platform 22 to the lower marine riser package 24. The drilling riser string 20 enables drill pipe 32 to be deployed from the floating platform 22 to the lower marine riser package 24 and on through the wellhead 26 into the seabed through a central tube 34 formed by the riser joints 30. Drilling mud may be provided from the floating platform 22 through the drill pipe 32 and back to the floating platform 22 in the annulus between the drill pipe 32 and the inner walls of the central tube 34. Auxiliary tubes 36 formed by the riser string 20 may be used for other purposes, such as serving as choke-and-kill lines for re-circulating drilling mud below a blowout preventer (BOP) in the event that the BOP secures flow through the central tube 34.

Figure 2:
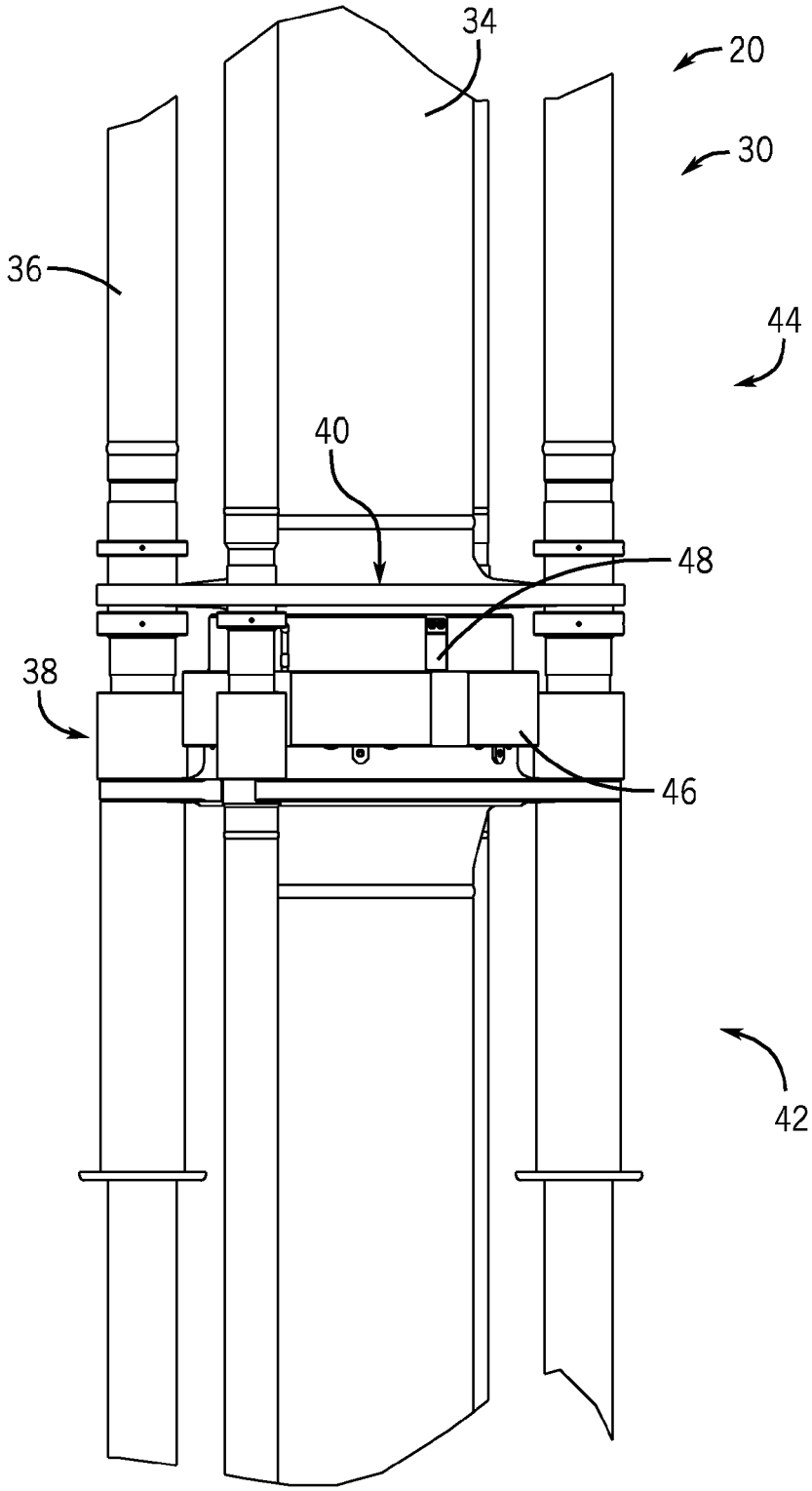
FIG. 2 is an elevation view of a portion of the drilling riser system of FIG. 1, in accordance with an exemplary embodiment of the present technique.
Figure 3:
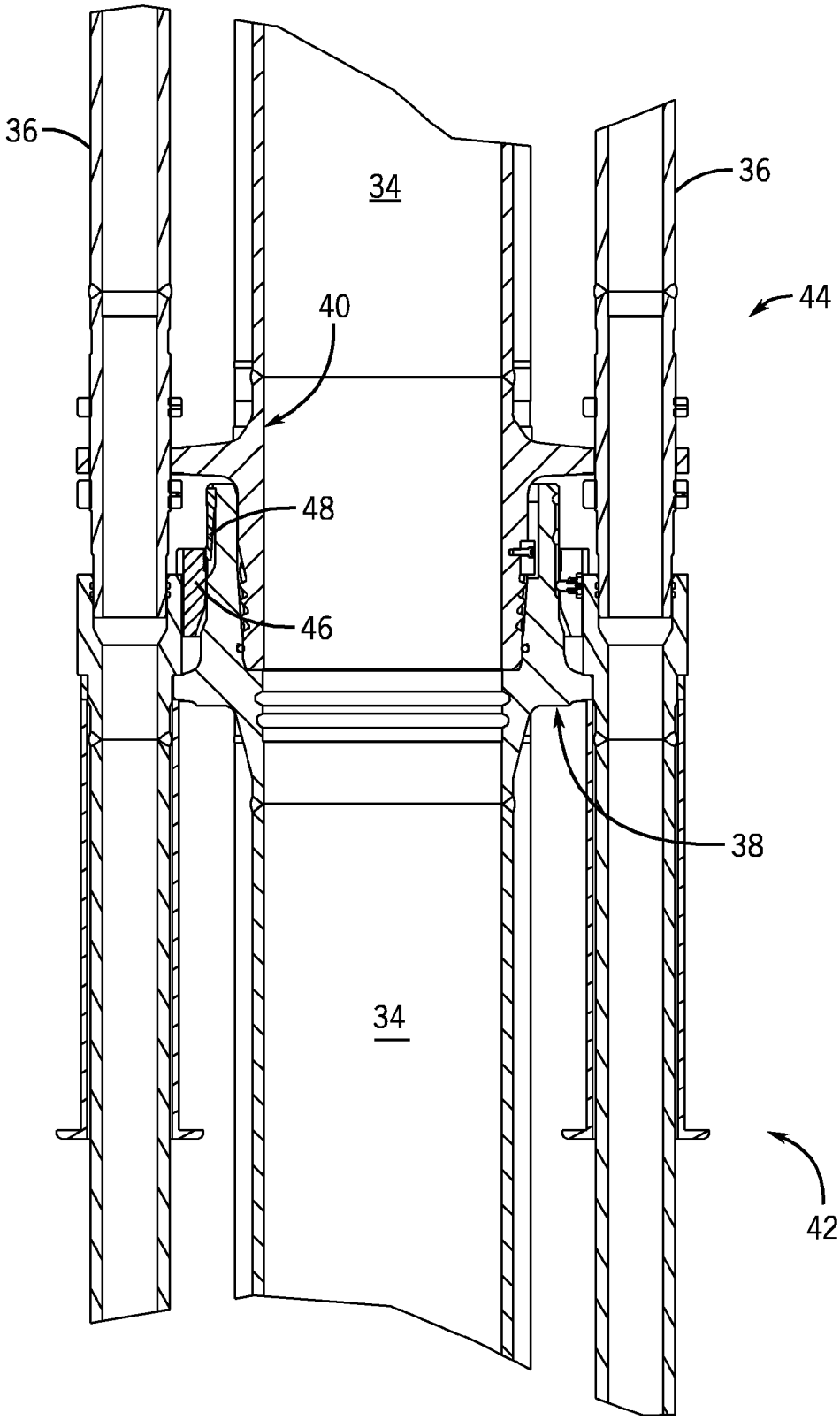
FIG. 3 is a cross-sectional view of the portion of the drilling riser system of FIG. 2, in accordance with an exemplary embodiment of the present technique.

Referring generally to FIGS. 2 and 3, each riser joint 30 has a box end 38 and a pin end 40 that are used to connect each riser joint 30 to another riser joint 30. As shown here, the box end 38 of a first riser joint 42 is connected to the pin end 40 of a second riser joint 44. In this embodiment, the first riser joint 42 is oriented in a box-up orientation and the second riser joint 44 is oriented in a pin-down orientation. However, the first and second riser joints 42, 44 may be oriented in the opposite orientation: pin-up/box-down. Here, the pin end 40 of the second riser joint 44 is stabbed into the box end 38 of the first riser joint 42. As will be discussed in more detail below, a tool is used to drive a cam ring 46 of the box end 38 of the first riser joint 42 downward from a first axial position to a second axial position to connect the second riser joint 44 to the first riser joint 42. The downward axial movement of the cam ring 46 urges a series of dogs (not shown in this view) disposed on the box end 38 of the first riser joint 42 inward against the pin end 40 of the second riser joint 44. The engagement of the dogs secures the second riser joint 44 to the first riser joint 42. To disconnect the first riser joint 42 and second riser joint 44, the cam ring 46 is lifted to release the dogs from engagement with the pin end 40 of the second riser joint 44.

In the illustrated embodiment, a latch 48 is provided to lock the cam ring 46 in the second axial position to maintain the second riser joint 44 connection to the first riser joint 42. The cam ring 46 is held in the second axial position by friction between the cam ring 46 and the dogs. However, the latch 48 provides an additional mechanism by which the cam ring 46 is prevented from being moved inadvertently from the second axial position to the first axial position. As will be discussed in more detail below, the latch 48 is mounted on the box end 38 of each riser joint 30 and engages the cam ring 46 when the cam ring 46 is driven downward to the second position. The engagement between the latch 48 and the cam ring 46 resists upward movement of the cam ring 46. Thus, the latch 48 maintains the second riser joint 44 connected to the first riser joint 42.

Referring generally to FIGS. 4-6, the latch 48 is adapted to cooperate with the cam ring 46 to prevent inadvertent axial movement of the cam ring 46. The illustrated embodiment of the latch 48 has a toothed profile 50 that is located on one end of a cantilever arm 52. The toothed profile 50 is configured to engage a corresponding grooved portion of the cam ring 46 when the cam ring 46 is positioned in the second axial position. Upward movement of the cam ring 46 from the second axial position to the first axial position is opposed by the engagement between the toothed profile 50 of the latch 48 and the corresponding grooved portion of the cam ring 46. The cantilever arm 52 biases the latch 48 outward so that the toothed profile 50 will engage the corresponding grooved profile of the cam ring 46. However, as will be discussed in more detail below, the cantilever arm 52 also enables the toothed profile 50 to be flexed inward during intentional axial movement of the cam ring 46 so that the toothed profile 50 of the latch 48 ratchets along the corresponding grooved portion of the cam ring 46. In addition, the illustrated embodiment of the latch 48 has a pair of mounting holes 54 for securing the latch 48 to the box end 38 of each riser joint 30. However, other arrangements and methods for securing the latch 48 to the riser joint 30 may be used.

Figure 7:
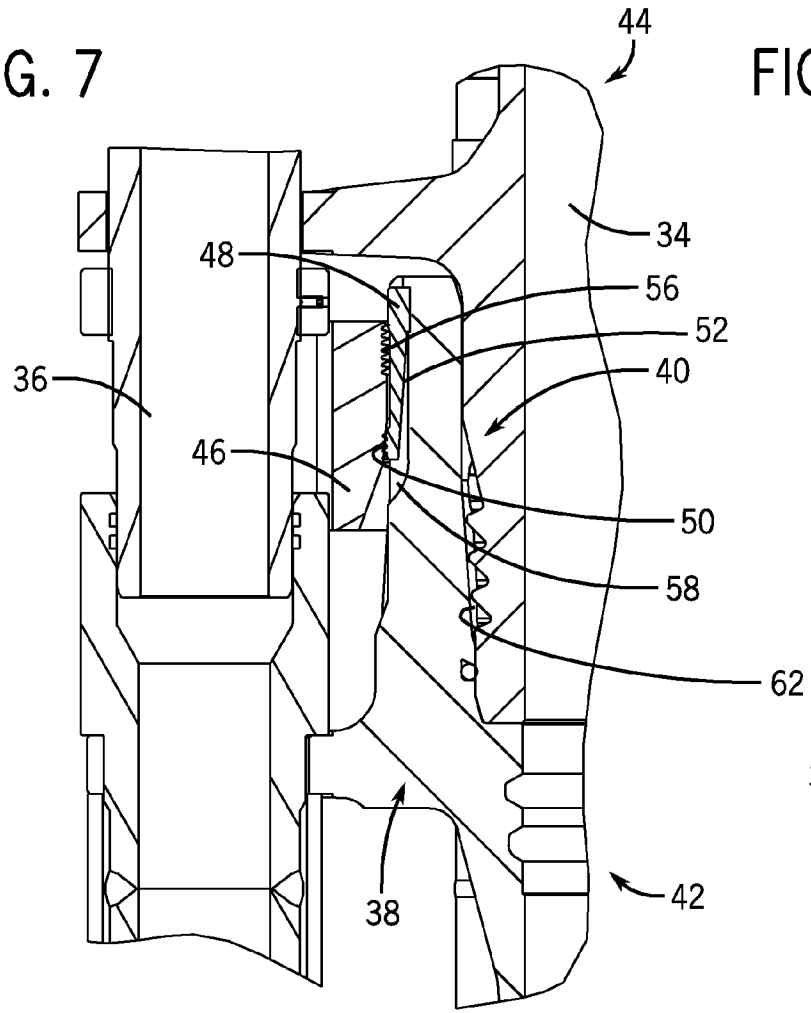
FIG. 7 is an elevation view of the first drilling riser joint and second drilling riser joint with a cam ring used to secure the first drilling joint to the second drilling riser joint in a first axial position, in accordance with an exemplary embodiment of the present technique.

Referring generally to FIG. 7, the cam ring 46 is presented in the first axial position on the box end 38 of the first riser joint 42. The cam ring 46 has a toothed profile 56 that is adapted to engage the toothed profile 50 of the latch 48. In this embodiment, the toothed profile 56 extends around the inner circumference of the cam ring 46. The toothed profile 50 of the latch 48 does not engage the toothed profile 56 of the cam ring 46 when the cam ring 46 is in the first axial position. Instead, the toothed profiles 50, 56 are configured so that they are engaged only when the cam ring 46 is at or near the second axial position. The box end 38 has a cavity 58 that is provided to receive the latch 48 as the latch 48 ratchets when the cam ring 46 is moved axially.

Referring generally to FIG. 8, the cam ring 46 is presented in the second axial position on the box end 38 of the first riser joint 42. When the cam ring 46 is driven downward, as represented by arrow 60, dogs (not shown) of the box end 38 of the first riser joint 42 are driven into an outer profile 62 of the pin end 40 of the second riser joint 44. The cantilever arm 52 of the latch 48 is biased outward from the cavity 58 to engage the toothed profile 50 of the latch 48 with the toothed profile 56 of the cam ring 46.

Referring generally to FIGS. 9 and 10, a tool 64 is used to connect the riser joints 30 to form the riser string 20. In the illustrated embodiment, the tool 64 has a plurality of retractable braces 66 that are extended outward to support a flange 68 of the first riser joint 42. The braces 66 also align the first riser joint 42 for connection with the second riser joint 44. The braces 66 are retracted to enable the first and second riser joints 42, 44 to pass through the tool 64 during assembly and disassembly of the riser string 20.

The tool 64 is adapted to connect the riser joints 30 in a box-up/pin-down configuration. The first riser joint 42 is supported in the tool 64 with the box end 38 upward in this embodiment. Consequently, the pin end 40 of the second riser joint 44 is inserted into the box end 38 of the first riser joint 42. The box end 38 of the first riser joint 42 has a plurality of dogs 70 that are used to connect the box end 38 of the first riser joint 42 to the pin end 40 of the second riser joint 44 are presented. The dogs 70 extend through windows 72 in the box end 38. As the cam ring 46 is driven downward to the second axial position, as represented by arrow 76, the dogs 70 are driven by the cam ring 46 inward, as represented by arrow 78, into engagement with the outer profile 62 of the pin end 40 of the second riser joint 44. The tool 64 has a plurality of retractable jaws 74 that are extended outward to engage the cam ring 46 and drive it axially downward or upward.

Referring generally to FIGS. 11-13, the jaws 74 are adapted to drive the cam ring 46 downward, as represented by arrow 76, to drive the dogs 70 of the first riser joint 42 inward, as represented by arrow 78, against the outer profile 62 of the pin end 40 of the second riser joint 44. In addition to the latches 48, friction between the inner surface 80 of the cam ring 46 and the outer surface 82 of the dogs 70 maintain the cam ring 46 in the second position.

Referring generally to FIG. 14, the illustrated embodiment of the box end 38 of a riser joint 30 utilizes three latches 48 that are disposed equidistant around the central tube 34 to maintain the cam ring 46 in the second axial position. However, a greater or lesser number of latches 48 may be used. As noted above, when the cam ring 46 is in the second axial position, the cam ring 46 drives dogs 70 against the pin end 40 of the upper riser 44 through windows 72 in the box end 38 of the lower riser 42, connecting the second riser joint 44 to the first riser joint 42.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A marine drilling riser system, comprising:

a marine drilling riser joint having a box end on a first end and a pin end on a second end;

a ring adapted to move axially from a first position to a second position to connect the marine drilling riser joint to a second tubular member, wherein a portion of the ring has a first surface profile;

a latch configured to maintain the ring axially positioned in the second position, the latch comprising a cantilever arm secured on one end to the box end of the tubular housing and a second surface profile disposed on the cantilever arm, the cantilever arm being configured to bias the second surface profile into abutment against the first surface profile of the ring, wherein axial movement of the ring from the second position to the first position is opposed by the abutment between the first surface profile and the second surface profile; and a spider configured to engage the ring to drive the ring between the first position and second position.

2. The marine drilling riser system as recited in claim 1, wherein the spider is configured to support the marine drilling riser joint as the spider engages the ring to drive the ring between the first position and second position.

3. The marine drilling riser system as recited in claim 1, comprising a plurality of engagement elements disposed on the first end of the marine drilling riser joint.

4. The marine drilling riser system as recited in claim 3, wherein the ring urges the plurality of engagement elements disposed on the first end of the marine riser joint into engagement with a mating profile of a second end of the second tubular housing as the ring is moved axially by the spider from the first position to the second position.

5. The marine drilling riser system as recited in claim 4, wherein the second end of the marine riser joint comprises a mating profile adapted to receive each of a plurality of engagement elements of an adjoining marine riser joint.

6. The marine drilling riser system as recited in claim 3, wherein each of the plurality of engagement elements extends through an opening in the marine riser joint.

7. The marine drilling riser system as recited in claim 1, wherein the second surface profile comprises a first plurality of teeth.

8. The marine drilling riser system as recited in claim 7, wherein the first surface profile comprises a second plurality of teeth adapted to receive the first plurality of teeth.

9. A drilling riser system, comprising:

a plurality of drilling riser joints, each of the plurality of drilling riser joints comprising:

a tubular housing;

a box end located at a first end of the tubular housing;

a ring adapted to move axially from a first position to a second position to connect the drilling riser joint to a second drilling riser joint, wherein a portion of the ring has a first toothed profile; and a latch secured to the box end, comprising a second toothed profile, wherein the latch is adapted to bias the second toothed profile into engagement with the first toothed profile on the ring when the ring is disposed in the second position so that engagement between the second toothed profile on the latch with the first toothed profile on the ring opposes axial movement of the ring from the second position to the first position; and a spider adapted to support one of the plurality of drilling riser joints and to drive a ring of one of the plurality of drilling riser joints axially from the first position to the second position.

10. The drilling riser system as recited in claim 9, wherein the latch comprises a cantilever arm, the second toothed profile being disposed on the cantilever arm and the cantilever arm being adapted to bias the second toothed profile into engagement with the first toothed profile on the ring.

11. The drilling riser system as recited in claim 10, wherein the cantilever arm and second toothed profile ratchet along the first toothed profile as the ring is moved axially to the second position.

12. The drilling riser system as recited in claim 9, wherein the box end comprises a cavity adapted to receive the cantilever arm as the cantilever arm and second toothed profile ratchet along the first toothed profile.

13. The drilling riser system as recited in claim wherein the latch is mounted to the box end by a removable fastener.

14. The drilling riser system as recited in claim 9, comprising a plurality of dogs disposed on the box end of the tubular housing.

15. The drilling riser system as recited in claim 14, wherein the spider comprises a plurality of arms configured to engage the ring of one of the plurality of drilling riser joints and drive the ring axially from the first position to the second position to urge the dogs disposed on the box end of the tubular housing into engagement with a pin end of one of the plurality of drilling riser joints.

16. The drilling riser system as recited in claim 14, comprising a pin end located at a second end of the tubular housing opposite the first end, wherein the pin end of the tubular housing comprises an outer profile adapted to receive each of the plurality of dogs.

* * * * *